US006580449B1

(12) United States Patent
Meltzer

(10) Patent No.: US 6,580,449 B1
(45) Date of Patent: Jun. 17, 2003

(54) BOREHOLE INSPECTION INSTRUMENT HAVING A LOW VOLTAGE, LOW POWER FIBER OPTIC LIGHT-HEAD

(75) Inventor: Brad A. Meltzer, Ventura, CA (US)

(73) Assignee: DHV International, Inc., Oxnard, CA (US)

( * ) Notice: Subject to any disclaimer, the term of this patent is extended or adjusted under 35 U.S.C. 154(b) by 511 days.

(21) Appl. No.: 09/618,316

(22) Filed: Jul. 18, 2000

(51) Int. Cl.[7] ..... H04N 7/18
(52) U.S. Cl. ..... 348/85; 356/241.1; 396/28
(58) Field of Search ..... 348/85; 356/241.1; 396/28; H04N 7/18

(56) References Cited

U.S. PATENT DOCUMENTS

| | | | | |
|---|---|---|---|---|
| RE24,076 E | * | 10/1955 | Laval, Jr. | 396/28 |
| 2,912,495 A | | 11/1959 | Moon et al. | 348/85 |
| 4,657,387 A | | 4/1987 | Heising et al. | 356/72 |
| 4,727,416 A | | 2/1988 | Cooper et al. | 348/66 |
| 4,837,615 A | | 6/1989 | Boshier | 348/82 |
| RE33,160 E | | 2/1990 | Guthrie et al. | 73/40.5 |
| 5,275,038 A | | 1/1994 | Sizer et al. | 73/152.02 |
| 5,287,133 A | * | 2/1994 | Bohley | 396/28 |
| 5,633,675 A | | 5/1997 | Danna et al. | 348/65 |
| 5,654,795 A | | 8/1997 | Dierlam | 356/241.1 |
| 5,663,758 A | * | 9/1997 | Linville | 348/85 |
| 5,682,199 A | | 10/1997 | Lankford | 348/72 |

FOREIGN PATENT DOCUMENTS

| | | | |
|---|---|---|---|
| EP | 0 264 511 | 4/1988 | H04N/7/18 |
| FR | 2 753 519 | 3/1998 | F21M/1/00 |
| JP | 63-292119 A | 11/1988 | G03B/15/02 |
| WO | WO 96/41066 | 12/1996 | E21B/47/00 |
| WO | WO 96/60249 | 11/1999 | E21B/47/00 |
| WO | WO 99/67569 | 12/1999 | F21P/5/00 |

* cited by examiner

*Primary Examiner*—Howard Britton
(74) *Attorney, Agent, or Firm*—Fulwider Patton Lee & Utecht, LLP

(57) ABSTRACT

An instrument for the inspection of well bores includes an improved light source contained within the same pressure barrel as the camera. A low power lamp is disposed within an elliptical-shaped reflector that reflects the lamp light to a focal point distal of the reflector. Optical fibers are disposed at that focal point and conduct the light received from the lamp to form an array of light sources disposed about the camera. An annular window disposed in the line of illumination of the array of light sources directs the illumination into the field of view of the camera. The light source arrangement provides an unobstructed and illuminated field of view for the camera. Because of the increased efficiency of the light source that includes the described elliptical reflector, a self-contained power system may be used in the instrument thereby resulting in a much smaller support cable for the instrument with the ability to inspect much smaller boreholes. Standard size batteries may be used in the power system. A slickline cable may be used with the disclosed instrument.

33 Claims, 7 Drawing Sheets

BOREHOLE INSPECTION INSTRUMENT HAVING A LOW VOLTAGE, LOW POWER FIBER OPTIC LIGHT-HEAD

BACKGROUND OF THE INVENTION

The present invention is directed generally towards the inspection of boreholes and other limited access passageways, and more particularly, to an inspection instrument having a low voltage, low power light-head and camera arrangement for capturing video images.

In drilling oil and gas wells it is often necessary to obtain information concerning conditions within the borehole. Where the borehole has casings and fittings, as is typical of production oil wells, there is a continuing need to inspect the casings and fittings for corrosion. The early detection of the onset of corrosion in borehole casings allows for the application of anti-corrosive compounds to the well. Early treatment of corrosive well conditions may prevent the need for expensive casing replacement procedures. Where the borehole may contain oil, natural gas, or water, it often proves convenient to verify the presence of these substances through visual examination.

There may also be a need to determine the entry points of fluids into a well. Where water is infiltrating an oil well, it is necessary to determine the point of entry so that steps may be taken to stop the infiltration. If a visual examination of a well bore reveals oil at one location and a mixture of oil and water at another location, it can be concluded that the infiltration of water is occurring at some point in between. By gradually moving a camera between the two locations, the point of infiltration may be located and consequently the flow of water may be blocked through subsequent action.

Although visual examination of well bores is highly desirable, the environmental conditions typical of oil and gas wells pose special problems that tend to hinder camera operation. Well bores range in depth from several hundred to several thousand feet. Consequently, hydrostatic pressure within a deep bore, in addition to high well head pressures caused by gas production, can be quite large and can reach and often exceed 70 mPa (10,000 pounds per square inch). Ambient well temperatures on the order of 135 degrees Celsius (275 degrees Fahrenheit) are not uncommon. In addition, oil wells typically contain highly corrosive hydrogen sulfide and carbon dioxide gases. These harsh environmental conditions dictate that cameras and associated lighting equipment must be enclosed within protective housings. Fluids collected in well bores further complicate the visualization problem. Collected fluids are generally dark, cloudy, and often contain mineral particulates in suspension. One effect most fluids found in well bores have is to reduce light transmission. For this reason, high intensity lights are generally required to illuminate a well bore sufficiently to obtain an adequate video image.

Prior devices for visually examining boreholes typically include a camera and a high intensity light source enclosed in a protective housing. The devices are generally attached to an armored cable that supports the device and provides electrical power and communication signals to the device. The cable is typically lowered and raised within the borehole by means of reel located at a surface station proximate the entrance to the borehole. The surface station further includes a power source and control apparatus for operation of the inspection device.

One constant problem facing down hole instrument designers is the need to make the instruments small enough to be usable in very narrow passageways, including those that have restrictions, such as small diameter pipes or casings but at the same time have the ability to provide high quality images, either in real time or stored for viewing later. Casings having internal restrictions, such as tubing, safety valves, or other devices, that result in an internal effective diameter of 44 millimeters (1¾ inches) are not uncommon. The need to provide both a camera and an associated light source can make the instrument too large to fit in such small diameter passageways.

Another problem faced by designers of borehole inspection devices is the effect of heat upon camera operation. Camera electronics possess a limited capacity to withstand heat and the combination of high ambient borehole temperatures and the heat generated by high intensity lighting systems may produce a temporary or permanent failure of the camera. Such failures can be quite expensive and time consuming as the instrument must either be raised until it cools down enough to once again come on line, or must be extracted from the borehole and replaced.

An example of an early borehole inspection device is one that includes a cylindrical housing into which is mounted a television camera and a light source in the form of a donut-shaped lamp that surrounds the television camera. The device also includes a coolant jacket and coolant that surrounds the heat sensitive camera electronics. Since the donut-shaped lamp surrounds the camera, heat developed by the lamp reaches the camera and will add to the heat environment the camera will experience. As discussed above, a level of heat that is too high will result in camera failure. The use of a cooling system in a down hole instrument is undesirable due to the added equipment that would be necessary, thereby increasing the size of the instrument, as well as the reliability considerations. The more equipment that is used, the more likely a failure will occur. Adding heat from a light source used to illuminate the field of view of the camera is also undesirable. Also, placing the lamp around the camera increases the diameter of the device thereby making it unusable in very restricted passageways. Approaches have been devised to longitudinally and physically separate the light source from the camera so that any heat developed by the light source will be generated at a distance from the camera. Once such approach is to mount the light source in front of the camera facing the field of view of the camera but separated from the camera by mounting arms. In this arrangement, the light source blocks a portion of the field of view of the camera, yet this approach has proven to be successful. In some applications however, is would be desirable to have a clear field of view for the camera.

A more modern borehole inspection device uses a back-lighted camera where the camera is suspended in front of a high intensity lamp and is axially separated from the lamp a sufficient distance to provide significant thermal isolation of the camera from the lamp. Light is directed into the camera's field of view by means of a reflector located behind the camera. By isolating the camera from the light source heat, a significant improvement in the art has been provided and this approach has proven successful. A back-light arrangement separates the heat generated by the light source from the camera resulting in cooler temperatures for the camera.

However, because back-lighting is used, a brighter light source is needed with an accompanying higher power requirement. More electrical energy must be provided to the light source so that enough light reaches the camera's field of view. Such increased power requirements either require a larger battery in the instrument, which can result in a larger and often impractical instrument, or power provided to the instrument through the cable which results in a larger cable. Additionally in this arrangement, the light source is exposed to the environment and must be sealed against contaminants, which is not a minor task. Further, the camera is extended from the light source by arms, which can be bent during operation. Bent arms can result in off-center view angles for the camera and if severe enough, the instrument must be withdrawn from the borehole and corrected.

Despite the above, the back-light approach has proven to be highly successful in large diameter tubular passageways. Better lighting is provided resulting in significantly better images. However, the back-light approach relies on the reflection of light from the walls of the passageway. In very small diameter passageways, the camera of the instrument has been found to be too large and it interferes with the needed reflection of light into the camera's field of view. Insufficient light is therefore delivered and the results are not as desirable. A smaller instrument would be more useful.

Hence, those skilled in the art have recognized the need for an improved borehole inspection instrument that utilizes a low voltage, low power, high intensity light-head that is physically separated from the camera to reduce heat applied to the camera. Additionally, such a light source should be enclosed within the same housing as the camera thereby reducing the need to seal components of the instrument from down hole conditions. There is also a need to provide a light source that requires less electrical energy to generate enough light for the camera's field of view. Further, a need has been recognized for a light source and camera arrangement wherein neither are mounted with arms. Yet further, a need has been recognized for a down hole instrument having a diameter small enough to fit within very small passageways, such as one with an effective diameter of 44 millimeters (1¾ inches). The present invention fulfills these and other needs.

SUMMARY OF THE INVENTION

Briefly and in general terms, the present invention is directed to an improved instrument for use in the inspection of boreholes. The inspection instrument comprises a camera and a light source arrangement. The light source is housed in the same housing or pressure barrel as the camera. An elliptical reflector is disposed about the light source to focus the light into an efficient light transmission system. The light transmission system forms an array about the camera to radiate light into the field of view of the camera. In a more detailed aspect, a shaped annular window is disposed in front of the light array to assist in dispersing the light from the array so that the illumination pattern is substantially coincident with the camera's field of view. In another more detailed aspect, the light transmission system comprises the use of an optical fiber light transmission system. A plurality of optical fibers may be used to conduct the light from the light source to the array about the camera.

In accordance with another aspect, the camera and light source are separated from each other physically. This physical separation provides a degree of thermal insulation to the camera from heat generated by the light source. In a more detailed aspect, the camera is located at the distal end of the pressure barrel with the light source axially spaced proximally in relation to the camera a sufficient distance to thermally isolate the light source from the camera. The optical fibers forming an array of light sources about the camera do not generate any significant heat but provide a sufficient amount of light to fully illuminate the camera's field of view. Because the light source array is approximately coplanar with the camera, a more efficient arrangement results. Disadvantages associated with backlighting the field of view, or with partially blocking the camera's field of view with a light source disposed in front of the camera are nonexistent with this arrangement.

In another detailed aspect, the position of the light source and elliptical reflector is adjustable so that precise positioning of the light source for maximum light transfer to the optical fibers is possible. The light source is placed at a first focal point of the elliptical reflector and the optical fibers are placed at the second focal point which is removed from the first focal point.

In a further detailed aspect, a plurality of optical fibers are used to form the light array about the camera. These optical fibers are gathered into a single bundle and their proximal ends are positioned at the second focal point of the light source reflector for maximum light transfer from the light source to the optical fibers. The distal ends of the individual fibers that comprise the bundle are located at points spaced about the periphery of the camera on approximately the same plane as the camera lens. This arrangement provides for an unobstructed field of illumination of the fibers and an unobstructed field of view of the camera.

In one arrangement, the images produced by the light/camera system in accordance with aspects of the invention are communicated to the surface through electrical or optical conductors in the support cable for real-time viewing and processing at the surface. The images may also be recorded at the surface, as is common. Power may also be provided from the surface through the support cable to operate the camera and light source.

In yet another aspect of the invention, a power supply that is completely internal to the instrument may be used to supply power to both the camera and the light source due to the increased efficiency of the light source arrangement. In yet another aspect, standard size batteries may be used as that power source. In a further aspect, standard size D-cell batteries or Lithium batteries may be used.

In yet further aspects, an inspection instrument in accordance with the invention may contain an internal memory for the storage in digital form of the images created by the camera. The instrument may also include a programable processor for programmed operation of the camera. With this arrangement, the inspection instrument is capable of autonomous operation. It is programmed before introduction into the borehole to be inspected to capture a series of images at a predetermined time interval or intervals. The instrument remains in the borehole until its memory is full, the image program has been completed, or the batteries have been depleted. The instrument is then removed from the borehole and at the surface, the images are retrieved from the digital memory. Those images may then be processed at the surface.

Because of this efficient operation and the use of a self-contained battery system in this arrangement, the support cable can be of minimal size and the instrument is particularly adapted for use in small diameter passageways. No power conductors or data communication conductors are needed in the support cable. A much smaller and more prevalent cable commonly known as a "slickline" may be used instead. A slickline is essentially a length of wire that is less expensive to operate and is far more available than electric line for field use. The need for surface support equipment is reduced (for example, no surface power supply is necessary) and the instrument is therefore more portable. The ability to run on a slickline results in an instrument that is usable in a much more diverse set of circumstances.

Other features and advantages of the invention will become more apparent from the following detailed description of preferred embodiments of the invention, when taken in conjunction with the accompanying exemplary drawings.

DETAILED DESCRIPTION OF THE PREFERRED EMBODIMENT

Figure 1:
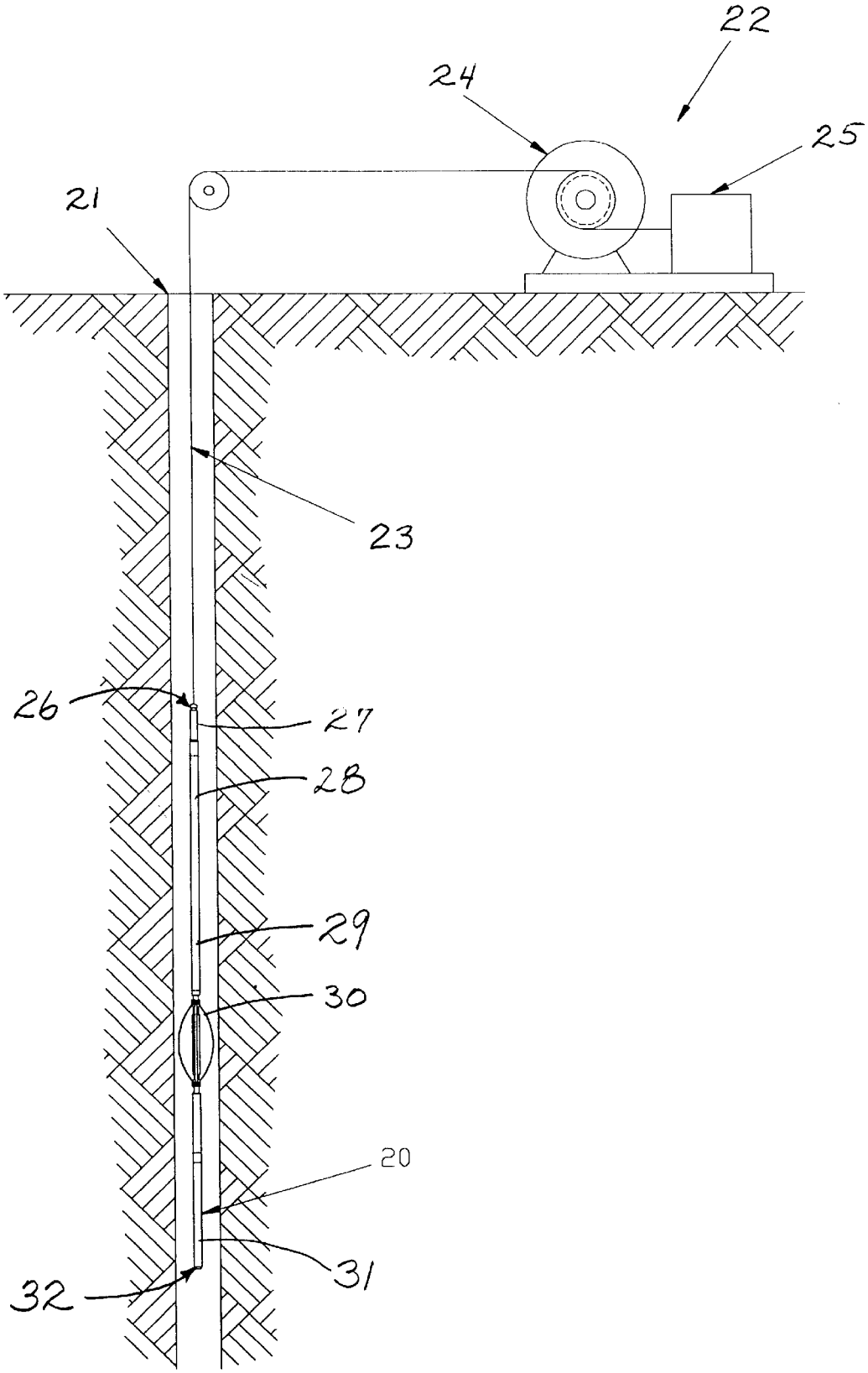
FIG. 1 is a view of a down hole inspection instrument suspended in a well bore for inspection of that bore, also showing an umbilical or support cable to the surface, and related surface equipment for controlling the depth of the instrument and for providing power and/or capturing images provided by the instrument, according to the particular configuration of the down hole instrument.

In the following description, like reference numerals will be used to refer to like or corresponding elements among the figures. Referring now to FIG. 1, a borehole inspection instrument 20 is shown located within a borehole 21. The inspection instrument 20 is connected to a surface station 22 by means of an armored support cable 23. This cable 23 may include strength members, insulation, a power conductor or conductors, and possibly an optical fiber or fibers for transmitting power and communication signals between the inspection instrument 20 and the surface station 22. Alternately, the cable 23 may take the form of a simple solid length of steel wire known as a "slickline" that does not contain any electrical or optical conductors. The support cable 23 is connected to the proximal end of the inspection instrument 20 by any conventional means known in the art.

In addition to transmitting power and communication signals, depending on the configuration, the support cable 23 is used to raise and lower the inspection instrument 20 within the borehole 21 by means of the rotation of a spool or winch 24 about which the cable 23 is wound. The spool 24 is located at the surface station 22. In the case where video or other data signals are transmitted by the inspection instrument 20 through the cable 23 to the surface station 22, data processing, recording, and display equipment 25 is provided for receiving the video signals. Typical surface equipment includes the winch or spool 24 to raise and lower the instrument 20 in the bore hole 21 and utilizes a depth measurement system (not shown) to provide accurate depth measurements to the operator. If the instrument 20 is operated on a slickline cable where the instrument is battery powered, the surface equipment 25 will not capture the images provided by the instrument 20 in real time. However, there would be some surface equipment to download data from the instrument 20 and display the images once the instrument 20 has been returned to the surface.

The down hole instrument 20 includes a camera and a light source. The light source illuminates the contents of the hole within the field of view of the camera and the camera produces images of the illuminated area. The camera images may be converted to optical or electrical signals and transmitted through the support cable 23 to the data processing and display equipment 25 at the surface. In the case of a battery-powered instrument, as will be described in more detail below, the images of the camera may be converted to digital representations and stored in a memory in the instrument for later processing.

It should be noted that FIG. 1 presents only one example of control mechanisms and surface data processing equipment coupled to a down hole instrument. Other arrangements exist.

With continued reference to FIG. 1, the instrument 20 in this case consists of multiple parts. At the proximal end 26 is the cable head 27 that is used to terminate the cable 23 and isolate power brought into the instrument 20 by the cable 23 from the well conditions. A battery pack section 28, if the instrument is to be operated on memory and run on slickline, is located adjacent the cable head 27. An electronics chassis 29 is connected to the battery pack section 28. The electronics chassis 29 receives the video signals from the camera and transmits them to the surface equipment 25 via the cable 23 or stores the video signals in memory as data, in the case of a battery powered instrument. A centralizer 30 is used to center the instrument 20 in the well bore 21 and has electrical through conductors to connect the camera and light source to the electronics chassis 29. Finally, the light head and camera section 31 is located at the distal end 32 of the instrument 20.

Other instrument arrangements are possible with more or fewer sections, or with different sections, or with different section arrangements. FIG. 1 presents only one embodiment of an instrument and should not be taken as limiting.

Figure 2:
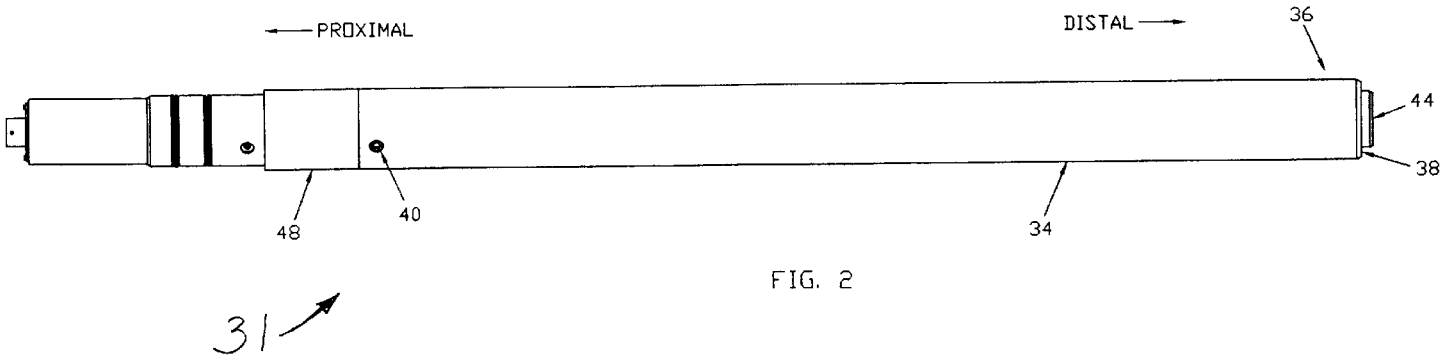
FIG. 2 is a side view of part of the instrument shown in FIG. 1, in which the light source is located and the camera is mounted at the distal end of the instrument.

Referring now to FIG. 2, a side view of part of the inspection instrument 20 shown in FIG. 1 is provided. FIG.

2 presents the light head/camera section 31 located at the distal end 32 of the instrument 20. The light head/camera section 31 comprises a sealed main housing or pressure barrel 34 terminating in a distal end 36 at which a port window 44 is located to present a clear view for the camera. An annular window 38 is also mounted in the distal end 36 and is used to direct light from the internal light source such that the entire field of view of the camera is illuminated. A further purpose of the port window 44 and the annular window 38 is to seal the distal end of the instrument from the entry of fluids and other contaminants from the well bore environment.

Access screws 40 (only one is shown) are used to secure the pressure barrel 34 in place. In a preferred embodiment, three access screws were used. Other quantities of access screws may be used however, depending on the design. Removing the access screws 40 will allow disassembly of the pressure barrel for maintenance of the instrument. Other arrangements for securing the pressure barrel 34 and for accessing the barrel 34 are possible.

Figure 3:
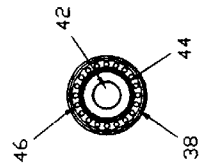
FIG. 3 is a front or distal end-on view of the inspection instrument shown in FIGS. 1 and 2 showing an array of light sources surrounding the camera lens.

Referring now to FIG. 3, an end-on view of the distal end 36 of the instrument 20 is shown in greater detail. A camera lens 42 can be seen behind the port window 44. The port window in this embodiment is formed of Pyrex®. Surrounding the camera lens 42 is an array of light sources 46 that, in this embodiment, comprise twenty equally-spaced sources. Also in this embodiment, the light sources 46 comprise the distal ends of optical fibers that terminate at a point behind the annular window 38. Distributions other than equal spacing may be possible with the light sources 46. However, the equally-spaced distribution shown in FIG. 3 results in uniform stress distribution across the annular window 38.

Figure 4:
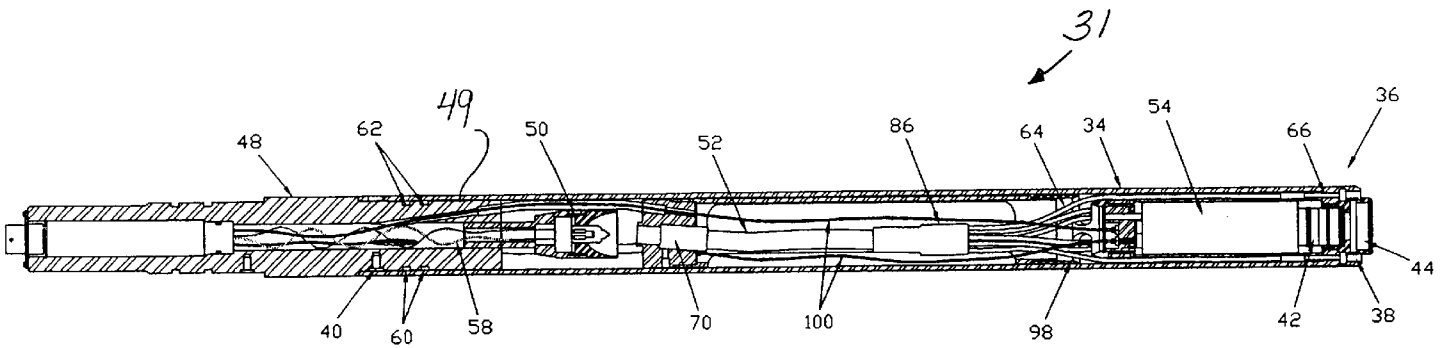
FIG. 4 is a sectional side view of the inspection instrument shown in FIG. 2 showing the light source arrangement with the light-conducting optical fibers and the camera mounted at the distal end of the instrument, which is physically separated from the light source for thermal isolation.

Turning now to FIG. 4, a cross-sectional view of FIG. 2 is shown. The light head/camera section 31 includes a core section 48 having a length of reduced diameter 49 for accepting the pressure barrel 34. The distal end 36 comprises the port window 44 and the annular window 38 that seal the distal end of the pressure barrel 34 from the borehole environment. Also included in the light head/camera section 31 are a light source section 50, an internal light transmission device 52, and a camera 54.

The pressure barrel 34 of the instrument 20 is formed as an elongated thin walled cylinder and includes provisions for securely positioning and retaining its internal components. The pressure barrel 34 may be formed of stainless steel or other material that is capable of withstanding the pressure, temperature, and corrosive environment typically associated with well bores. Environmental sealing may be accomplished by any conventional means, such as O-rings 60 that fit into O-ring grooves 62 machined into the core section 48. As can be seen from FIG. 4, the center and distal sections of the light head/camera section 31 are formed by sliding the pressure barrel 34 over the reduced diameter part 49 of the core section 48 and over the O-rings 60 until the pressure barrel abuts the core section 48. The pressure barrel 34 is then secured to the core section 48 by the access screws 40.

As can be seen by reference to FIG. 4, the light source section 50 is located in the approximate center of the head/camera section 31 and is longitudinally separated from the camera 54, which is located at the distal end 36. Electrical conductors 58 providing power to the light source section 50 are shown. Since light sources generate heat as well as light, this physical separation of the two components has the advantageous result of providing some thermal insulation to the camera from that light source heat. But because the light source and the camera lens are physically separated, and because the light source is located within the same housing or pressure barrel as the camera, some means was needed to transfer the light generated by the light source to an efficient point where the light could be radiated outside the instrument into the field of view of the camera. The array of light sources shown in FIG. 3 was selected as they are immediately adjacent the camera lens and they radiate light directly into the camera's full field of view. Reflections, back-lighting, or separate barrels dedicated to light sources are not necessary when using the arrangement shown in FIG. 4.

In addition to the beneficial thermal insulation provided by the physical separation of the light source from the camera in the instrument shown in FIG. 4, a novel approach to conducting the light from the light source to the camera field of view is also provided. The light source section 50 comprises an internal light transmission device 52 that includes a bundle 64 of optical fibers separated at their distal ends 66 to form branches 46 resulting in the array of twenty light sources 46 as shown in FIG. 3. The distal ends of the optical fibers are oriented so that in combination with the annular window 38, the light they radiate illuminates the camera's entire field of view.

The annular window 38 operates as a lens in that it refracts the light from the optical fibers into the field of view of the camera. In most cases, the outward facing surface of the annular window will be concave in shape to achieve the desired refraction and lens effect. However, the outward facing surface may have other shapes such as a faceted shape or other. Additionally, the inner facing surface of the annular window 38 may have a particular shape for achieving the lens effect. The annular window 38 may be considered a lens in that it refracts the light from each of the light sources into a diverging pattern coincident with the field of view of the camera.

The proximal ends 68 of the branches 46 of optical fibers are closely packed together within a sleeve 70 to form the bundle 64 and are located so as to receive light from the light source in a novel manner, as is described below in more detail. In the embodiment shown, each of the twenty branches 46 of optical fibers has a diameter of approximately 1.65 mm (0.065 in.). The twenty branches 46 come together at their proximal ends to form the bundle 69 that is approximately 7.62 mm (0.300 in.) in diameter. The actual glass fibers that make up each branch 46 are approximately 0.051 mm (0.002 in.) in diameter. Thus there are tens of thousands of individual glass fibers used to make the bundle 64 of branches 46. The efficiency of such a bundle of optical fibers can be on the order of about 60% over the entire length. When comparing this efficiency to the transmission of light through air such as that used in a back light approach, which diminishes the intensity of light in proportion to the square of the distance in air, it will be seen that the fiber optic approach in accordance with this aspect of the invention is far more efficient.

Figure 5:
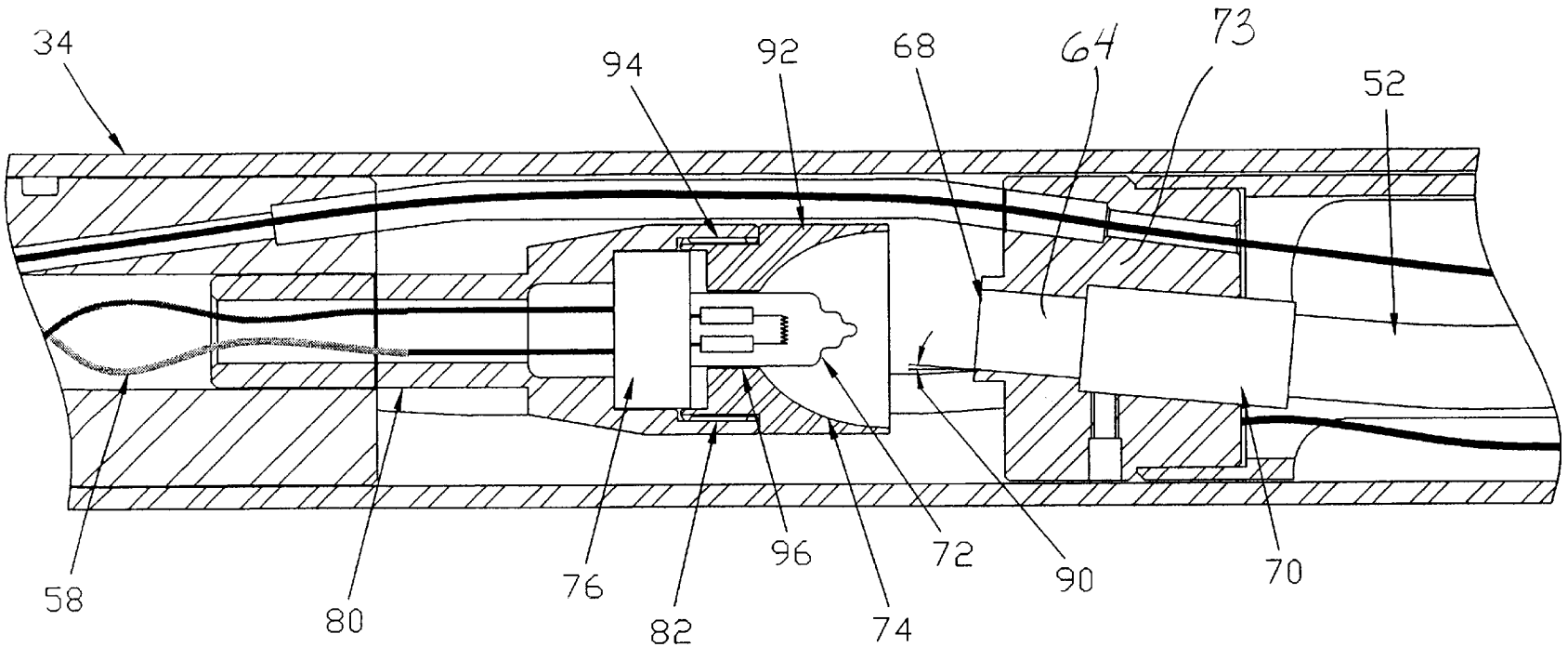
FIG. 5 is a partial cutaway view in enlarged scale of a portion of the inspection instrument of FIG. 2, showing details of the lighting system in accordance with aspects of the present invention.
Figure 8:
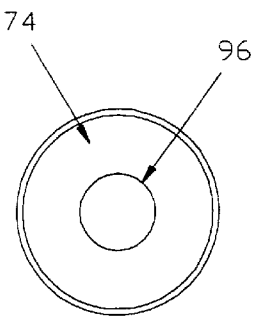
FIG. 8 is a front view of the elliptical reflector of FIG. 6.
Figure 6:
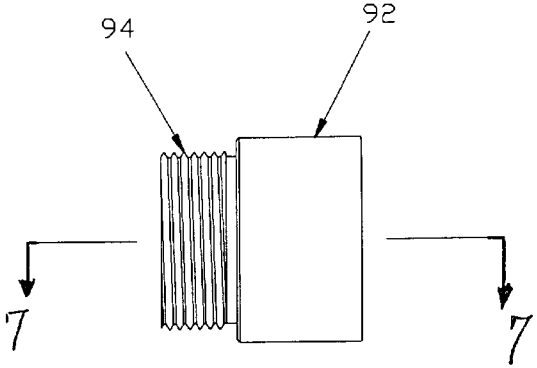
FIG. 6 presents a side view of an elliptical reflector in accordance with one aspect of the invention used in the lighting system of FIG. 5 to concentrate light provided by a bulb at a first focal point to a second focal point at which the proximal ends of optical fibers are located.
Figure 7:
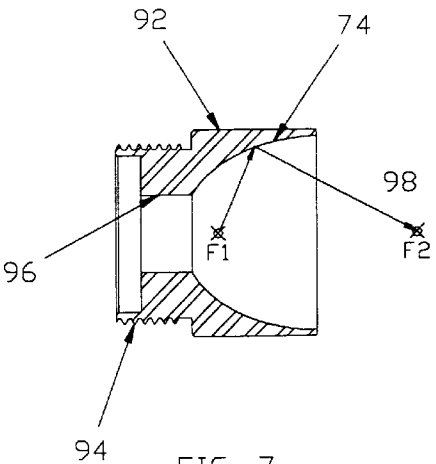
FIG. 7 is a sectional view taken along the lines 7—7 of the elliptical reflector shown in FIG. 6 showing the internal reflector and the two focal points of the ellipse, of which the reflector forms a part.
Figure 9:
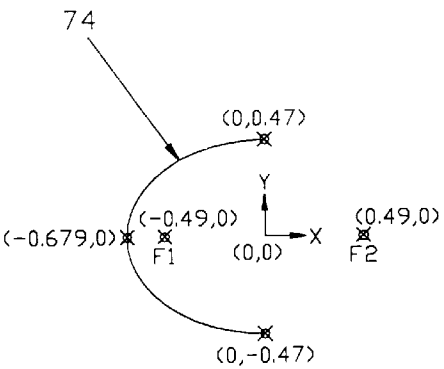
FIG. 9 is a graph of the elliptical surface of the reflector of FIGS. 6, 7, and 8.

Referring now to FIG. 5, the light source section 50 is shown in greater detail. A light generating device, such as a miniature lamp 72 is located within a reflector 74. The miniature bulb 72 is preferably a miniature tungsten halogen quartz lamp; however, there are a variety of lamps available that will yield satisfactory results. The preferred lamp generates 20 watts of power at 24 volts.

Therefore, the maximum power setting is at 24 volts and operates with a current level of 0.833 amperes. In one case, a halogen quartz lamp made by Ushio was effectively used.

The lamp 72 is secured within a lamp socket 76, which may be any commercially available socket that supports the selected lamp. The lamp socket 76 is wired to the power transmission lines 58 within the pressure barrel 34. The lamp socket 76 and the lamp 72 are secured within a lamp socket sleeve 80. The sleeve 80 is fixed at its proximal end to the pressure barrel 34 and includes a threaded portion 82 at its distal end for receipt of the reflector body 92. The sleeve 80 is preferably made of stainless steel for strength so that the light source assembly 50 can be securely mounted in the instrument. The stainless steel also functions to remove a portion of the heat generated by the lamp 72 from the immediate area of the light source section 50 to the core section 48 and then to the pressure barrel 34. The external fluid in contact with the pressure barrel 34 assists in dissipating the excess heat. The lamp 72 is mounted within the reflector 74 and the bundle of optical fibers 64 is located so that the proximal ends 68 of the fibers face the lamp and reflector.

The individual fibers that make up each branch 46 of the bundle 64 are brought together at the proximal end 68 and closely packed in the circular bundle 64. The proximal end 68 of the bundle utilizes a metal tip 70 surrounding the bundle, The individual fibers are aligned and potted into the metal tip 70 to permanently retain their alignment. The end of the bundle is then polished to increase the efficiency of light entering the bundle. The metal tip 70 is used to secure the bundle 64 in a metal housing 73 that locates the proximal end 68 of the bundle precisely in the center of the instrument along an axis, which is five degrees off the main axis of the instrument. The bundle 64 is set off axis to achieve optimum light reception from the lamp 72 and for maximum illumination from the distal end of each branch 46. The mounting angle selected for the proximal end of the bundle may vary depending on the manufacturer of the optical fibers. Five degrees was the optimum for the fibers used in one embodiment. A larger angle would yield excessive reflectance losses and an angle of less than five degrees yields a dark spot in the fiber's dispersion pattern.

The distal ends 66 of the fiber branches 46 are also equipped with metal end tips. The metal end tips serve two purposes. They allow the manufacturer of the fiber optic bundle to pot the fiber in the optimum alignment and polish the ends 66 for maximum dispersion of light. The end tips also allow location of each branch 46 at precise points behind the annular window 38 such that the instrument will yield repeatable results.

Turning now to FIGS. 5, 6, 7, 8, and 9, the reflector 74 is elliptical in shape and is formed within a cylindrical body 92 having a threaded portion 94 for receipt within the lamp socket sleeve 80. The interior of the cylindrical body 92 is formed into the elliptical surface 74 and has a center bore 96 through which the lamp 72 extends. As is shown, the illumination-producing part of the lamp 72 extends into the elliptical reflector 74 and is located at a first focal point "F1" of the reflector. The elliptical surface 74 conforms to the following equation of an ellipse which is illustrated graphically in FIG. 9.

$$\frac{x^2}{0.679^2} + \frac{y^2}{0.470^2} = 1$$

In accordance with the standard configuration of an ellipse, the elliptical surface 74, which is part of the shape of a full ellipse, has a first focal point "F1" and a second focal point "F2" located at a position removed from the first focal point but in accordance with the ellipse equation above. The two convergent focal points F1 and F2 are an inherent and unique property of elliptical surfaces. Light radiated at the first focal point F1 will be reflected by the elliptical surface 74 to focus at the second focal point F2 and vice versa. This principle of elliptical surfaces is depicted graphically in FIG. 7, where a light ray 98 emanating from the first focal point F1 within the reflector 74 strikes the elliptical surface 74 and is reflected to the second focal point F2.

This feature of elliptical reflectors is used advantageously in the instrument 20. In accordance with an aspect of the present invention, the lamp 72 is located at one focal point F1 and the light receiving end 68 of the fiber optic bundle sleeve 70 is located at another focal point F2. Therefore, light produced by the lamp 72 is reflected by the reflector 74 and focused at the second focal point F2 where the proximal ends of the optical fibers are located and are oriented for maximum light reception. This arrangement results in a much higher amount of light reaching the optical fiber bundle 64 from the lamp. Not only is light received directly from the lamp 72 by the optical fibers, light radiated by the lamp in other directions is reflected by the reflector 74 to a focal point coinciding with the location of the proximal ends of the optical fibers thereby greatly increasing the amount of light received by the optical fibers. This increased amount of light received by the fibers is conduced by those fibers to the array disposed about the camera for radiation into the camera's field of view. Because of the greatly increased efficiency of light transfer provided by this aspect of the invention, a smaller light source may be used and that light source will have a smaller power requirement.

The ability of an elliptical reflector to focus light at a second focal point distal from the first focal point is in marked contrast to parabolic reflectors which provide a beam-shaped pattern focused at infinity or to conical reflectors which possess a diverging cone shaped dispersion pattern. In either of the parabolic or conical reflectors, light generated by a lamp located at the reflector would not be focused at the proximal ends of optical fibers and only a portion of the reflected light would be received by the fibers. There would be a lower efficiency of light transfer from the lamp 72 to the optical fibers.

The center-bore 96 of the reflector body 92 is selected to have a diameter larger than that of the lamp 72. Upon attachment of the elliptical reflector body 92 to the lamp socket sleeve 80, the lamp 72 passes through the center bore 96 and protrudes into the reflector 74. The depth of the threaded portion 94 is selected such that the filament of the lamp 72 is centered at the first focal point F1 of the reflector 74. The threaded connection between the reflector body 92 and the lamp 72 allows for fine adjustment of the lamp's position within the reflector 74.

The elliptical surface 74 of the reflector is polished to a mirror like finish having a surface roughness of about 0.025 $\mu$m (1 $\mu$ inch) to about 0.012 $\mu$m (0.5 $\mu$ inch). The reflector 74 may be made of any material that is heat resistant and can be highly polished. A stainless steel alloy would be preferred because stainless steel will retain a polish longer without oxidation. However a polished aluminum alloy can also be used. Aluminum is easier to machine and polish and is shielded from the environment in this instrument. However, the polished surface of an aluminum reflector will tarnish or oxidize more quickly than would the same surface in stainless steel. Another option is to have the reflector electroplated or otherwise coated to resist surface oxidation.

Figure 10:
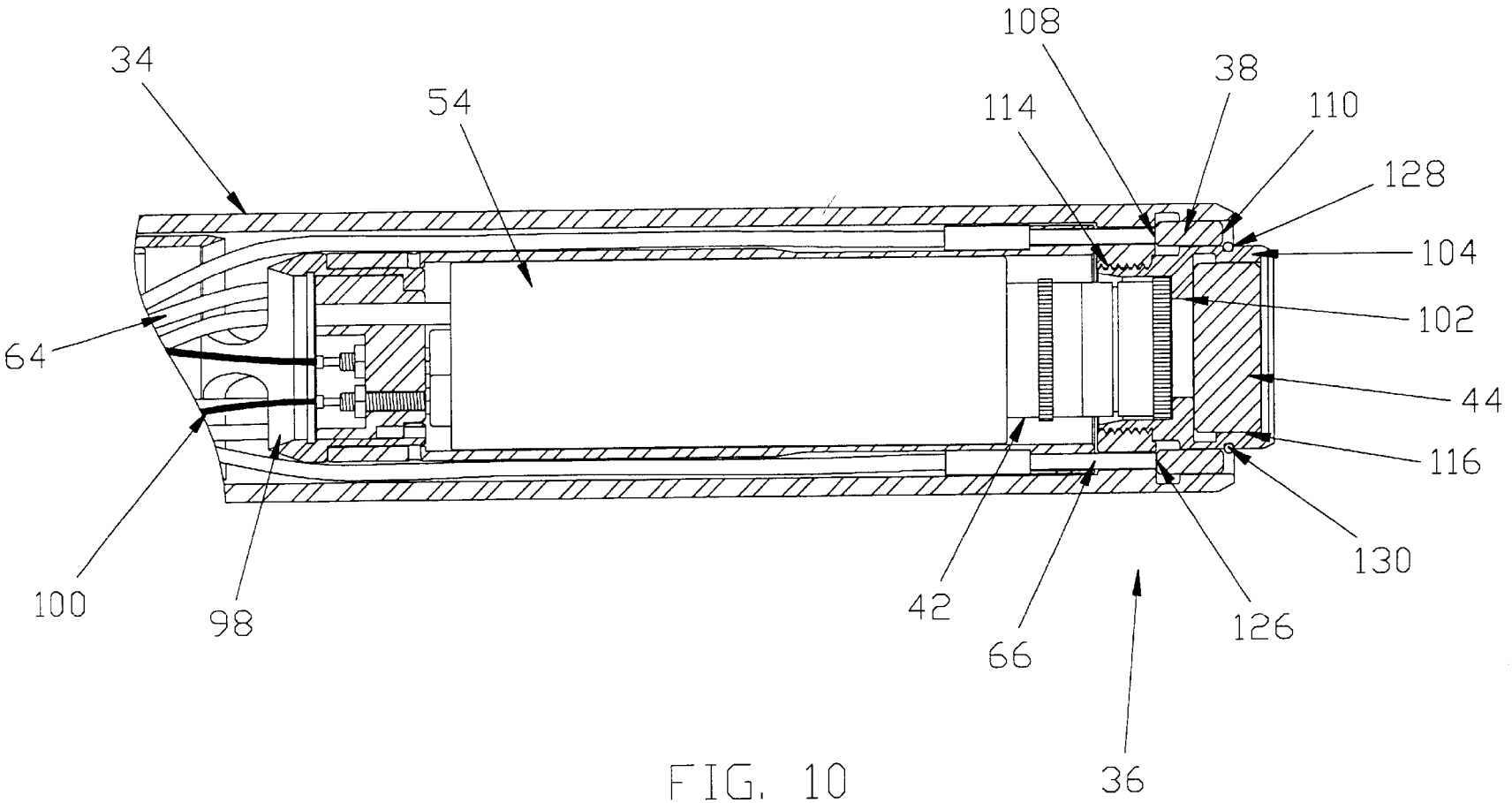
FIG. 10 is a partial cutaway view in enlarged scale of the inspection instrument of FIG. 2, showing details of the viewport, the lighting assembly, and the camera at the distal end of the instrument.

Returning briefly to FIG. 4 and also shown in FIG. 10, at the distal end 86 of the fiber sleeve 70, the optical fibers 64 branch out and are routed through a fiber alignment guide 98 that arrays the fibers 64 equally spaced from adjacent fibers about the perimeter of the camera 54 to produce a uniform dispersion or illumination pattern. The distal ends 66 of the fibers 64 terminate adjacent the port window 44.

Referring now to FIG. 10, the camera 54 is securely held within the pressure barrel 34 by means of the stainless steel fiber alignment guide 98. The camera 54 is connected to electrical and data conductors indicated collectively by numeral 100. The camera 54 is positioned behind the port window 44 and is optically coupled to the port window by means of a circular bore 102 in the viewport retainer 104 so that the field of view of the camera is distal of the port window. The camera may have a lens with selected optical characteristics, such as wide angle or telephoto capabilities, for particular viewing purposes. The camera is protected from external fluids and gasses by means of seals around the port window 44.

Figure 11:
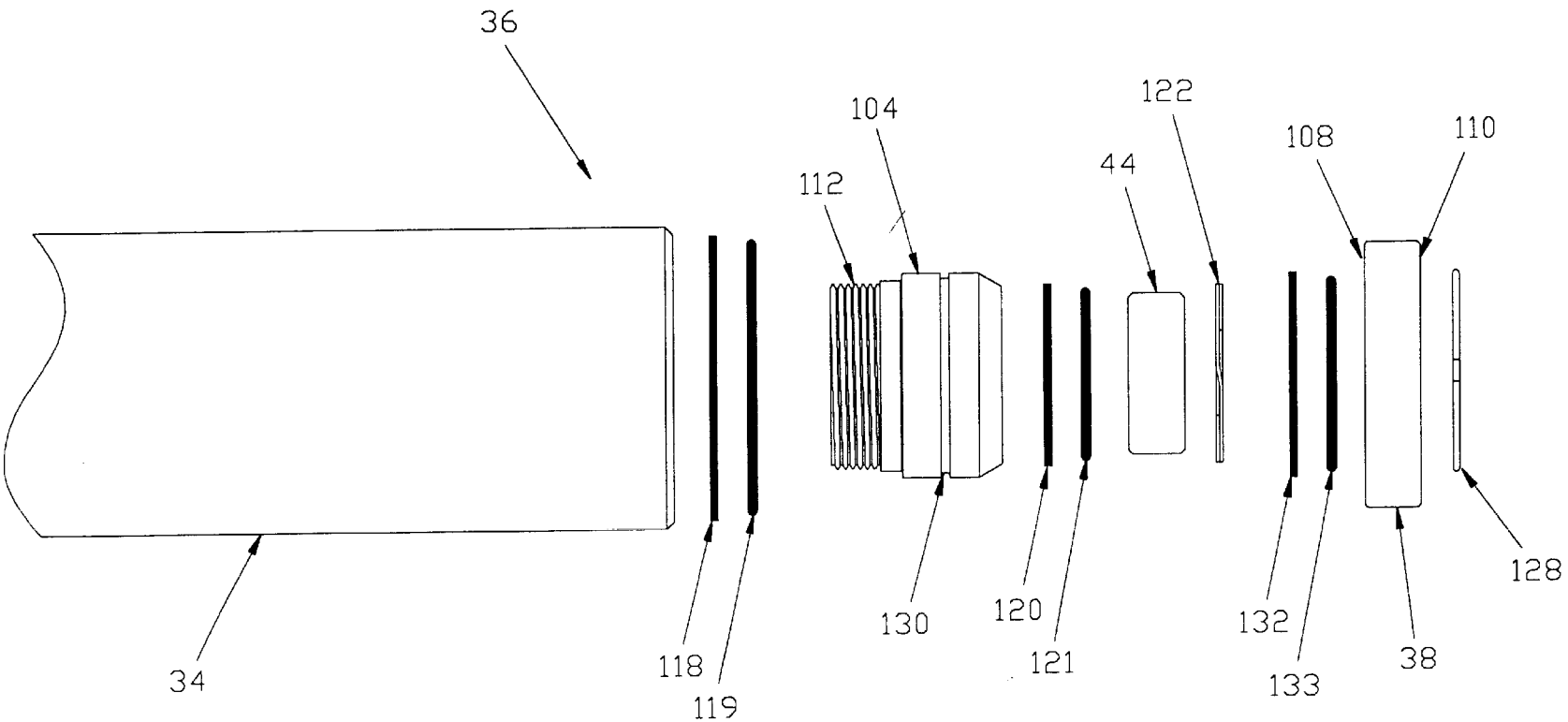
FIG. 11 is an exploded view of the viewport assembly shown in FIG. 10.

Referring now to FIGS. 10 and 11, the distal end of the instrument 20 comprises three main components, a viewport retainer 104, the port window 44, and an annular window 38 positioned in front of the optical fiber distal ends 66. The annular window 38 possesses refractive properties and serves to direct the light from the optical fibers in a dispersion pattern approximately coincident with the field of view of the camera 54. To achieve this effect, the annular window 38 is formed as an annular ring having a proximal face 108 and a distal face 110. The proximal face 108 is flat and is perpendicular to the longitudinal axis of the pressure barrel 34 The distal face 110 is formed with a concave radius of curvature which directs emitted light from the distal ends 66 of the optical fibers 64 at a fifteen degree angle outward towards the wall of the borehole in this embodiment. The annular window 38 is positioned approximately coplanar with the camera lens 42. This "side lighting" position provides for unobstructed lighting of the camera's field of view and neither provides a front light nor a back light to the camera. This is particularly advantageous in small boreholes where light from a front lit or back lit camera tends to be "choked" in a narrow ring around the borehole wall, failing to adequately illuminate as large a volume of the camera's field of view as is desired. The annular window 38 may be formed of any optically transparent material that can withstand typical borehole conditions. Pyrex® is the presently preferred material. The refractive index of the Pyrex acts with the concave face to diverge the light approximately fifteen degrees in one embodiment. This divergence of light ensures that the entire field of view of the camera will be adequately illuminated.

The port window 44 serves to protect the camera from the borehole environment and is formed as a solid circular disk. As the annular window 38, the port window 44 may be made of any suitable material, with fully tempered Pyrex® being the presently preferred material.

The viewport retainer 104 serves to securely hold the port 44 and annular windows 38, and seal the proximal end 32 of the pressure barrel 34 from the borehole environment. The viewport retainer 104 may be formed of any material that can withstand the pressure, temperature, and corrosive gasses found in a typical borehole, with a beryllium-copper alloy being preferred. Stainless steel on stainless steel threads tend to seize without adequate lubrication, therefore a beryllium-copper alloy was used due to its high yield strength and corrosion resistant properties. The port 44 and annular windows 38, may be secured and sealed in the retainer 104 by any known means. O-rings and circular retaining rings are used in the presently preferred embodiment.

The retainer 104 is presently formed as a cylindrical body with a threaded portion 112 for threadable engagement with a mating ring 114 formed integrally with the pressure barrel 34. The retainer 104 also includes the camera lens 42 center bore 102 that allows the camera to see the port window 44. The retainer 104 holds the port window 44 in a retaining bore 116 just proximal of which is an O-ring groove for receipt of O-rings 120, that seal the camera 54 from external gasses and fluids. The port window 44 is secured in the retaining bore 116 by a spiral retaining ring 122 that fits in a ring groove in the retainer 104. The annular window 106 is held in an annular pocket 126 formed between the outside of the viewport retainer 104 and the inside of the pressure barrel 34. A circular retaining ring 128 that fits in a ring groove 130 on the retainer 104 secures the annular window 38 in place. The annular window 38 is sealed against external fluids and gasses by means of O-rings 118/119 and 132/133 that fit into 0-ring grooves located in the pressure barrel 34 and on the viewport retainer 104 respectively.

Figure 12:
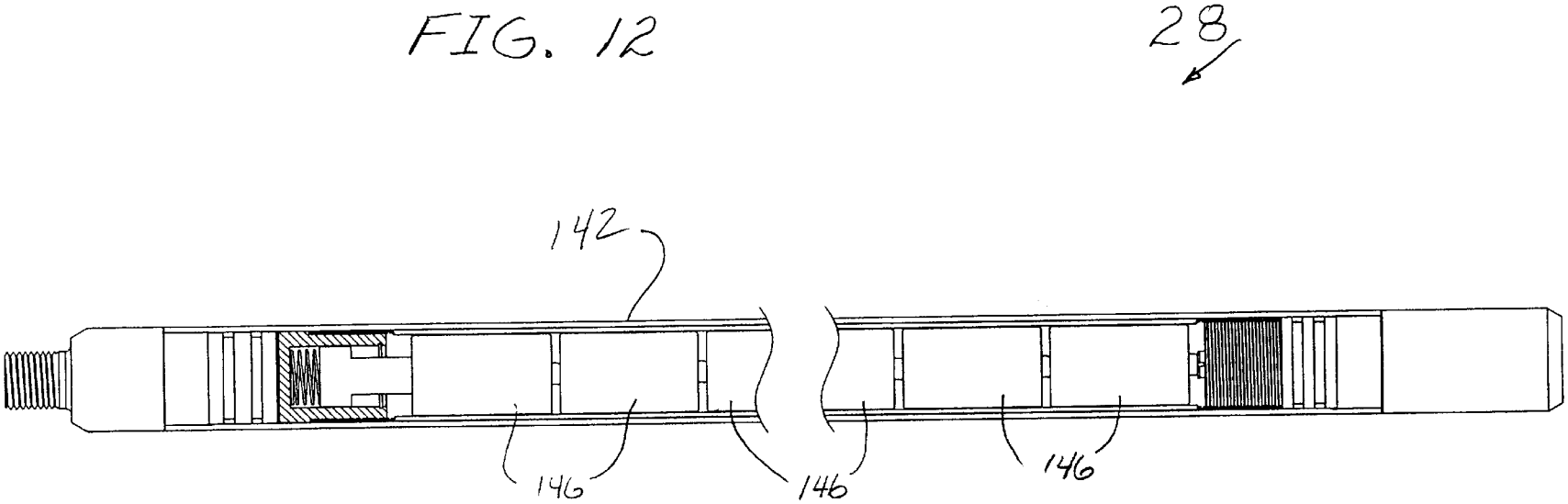
FIG. 12 is a side view of another embodiment of an inspection instrument in accordance with aspects of the invention in which the instrument has a self-contained power supply in the form of a plurality of commonly-available dry cell batteries.

Referring now to FIG. 12, the battery pack section 28 shown previously in FIG. 1 is shown in cross-section. The battery pack section 28 includes an internal power supply composed of multiple batteries 146. When so configured, the inspection instrument 20 eliminates the need to transmit power and communication signals through a support cable 26, and the slickline discussed above can be used with the attendant advantages also discussed above. The instrument, or "tool string", in such a case may comprise a low power light head/camera section, a centralizer section, a memory electronics section, and a battery section for power. The centralizer is optional but is often used. The memory electronics section controls the light source and camera and delivers the power from the battery section to them. It also receives the analog video signals from the camera and converts those signals into digital data that are stored in memory within the chassis.

In one embodiment of the battery pack section 28, seventeen D-cell alkaline batteries 146 were used to create a power supply capable of delivering one ampere of current for a duration of one minute of continuous operation. D-cell batteries are "off-the-shelf" batteries that are commercially available throughout most of the world. This is particularly advantageous where the boreholes requiring inspection are located in remote regions, which is frequently the case with oil exploration and production. The battery pack section 28 also includes a pressure barrel 142 to seal the batteries from the well bore environment. The proximal connection on the battery section may be a 15.875 mm (⅝ in.) sucker rod pin, which is a standard cable head connection in the slickline industry.

Figure 13:
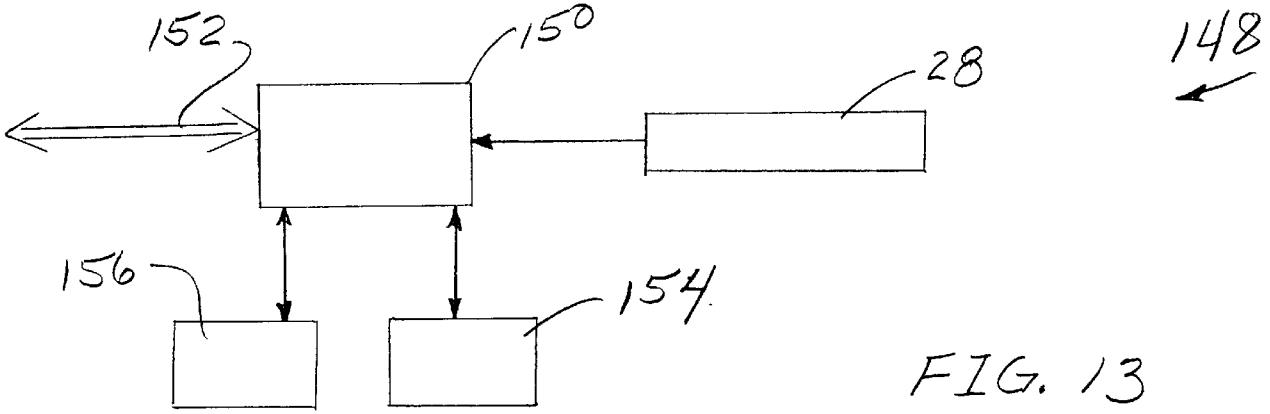
FIG. 13 is a block diagram of part of a memory electronics chassis section of a down hole instrument usable in accordance with certain aspects of the invention.

Referring now to FIG. 13, a portion of a memory electronics section 148 is shown. A processor 150 is programmed at the surface prior to introduction of the instrument 20 into the well bore hole. The processor can be programmed to take a given number of pictures at distinct times in the future or to take all of the pictures in sequential order with a predetermined interval, starting at a distinct time in the future. Based on the selected method of programming, the operator can run the instrument 20 into the well bore and reach the target depth before the predetermined time interval expires. Once the time has been reached when the pictures have begun, the operator can use the winch at the surface to move the instrument up or down to create a video log of a given section of the well bore. After all of the pictures have been taken and stored in memory, the operator would remove the instrument from the well and download the stored pictures for viewing.

In accordance with FIG. 13, the processor 150 is programmed at the surface through its input/output port 152. The processor is powered by the battery section 28. At the preprogrammed time, the processor 150 activates the light and camera 154 to create pictures of the well. The analog data representative of the pictures taken are converted to digital data by the processor 150 and are stored in the memory 156. Upon extraction of the instrument, the digital data stored in the memory 156 that is representative of the pictures taken are downloaded from the memory 156 by the processor 150 through the input/output port 152. The digital data may be used at the surface to reconstruct the pictures of the well bore for analysis and future action, if needed.

In one case, the processor 150 may be programmed for ten second imaging. That is, the camera is powered up, the lamp is energized, the camera takes images for ten seconds, and then both the camera and light are de-energized. This cycle recurs until the memory 156 is full or the batteries 146 are depleted.

The advantages of using such a memory camera instrument 20 are numerous; however, many are tied to cost and/or convenience. Fiber optic cables are rare and not commercially available. In order to run a fiber optic video log in an oil or gas well, a special fiber optic cable must be mobilized. That typically involves a designated truck for land projects or a designated skid unit containing a winch, fiber optic cable, and all of the surface control equipment for offshore projects. The mobilization of such equipment is not always practical and can be very costly. An alternative to fiber optic video is an updating still shot camera system, which operates on a standard electric line cable. Electric lines are very common in the industry but they are not a standard feature of every oil well. An electric line truck or skid unit can be more easily mobilized for these occasions but it too can be quite expensive.

In contrast, slickline is a solid piece of metal wire, which is very small and inexpensive but not capable of transmitting power or information to and from the instrument. It is so inexpensive to own and operate that it is considered to be a standard feature in most oil fields. Because it is nearly always available on site, the mobilization expenses are eliminated. For these reasons, a portable memory camera system that can be run on slickline would provide a much more available and cost effective instrument for most operators. Additionally, since slickline is so small in diameter, it is also simpler and more cost effective to use with pressure control equipment on wells producing gas.

Thus, in accordance with the invention, a new and useful inspection instrument is provided having an improved light transmission system for illuminating the field of view of the camera. In accordance with the invention, both an instrument capable of operating on electric line and on slickline has been described and shown. A single instrument barrel is used that houses both the camera and the light source for the camera. Due to a unique arrangement, the lighting source is physically separated from the camera, yet the light from the source is delivered to the camera's field of view at a point approximately coplanar with the camera lens at high efficiency. The light source includes a novel arrangement where a reflector is used to concentrate the light produced by a lamp at a higher efficiency light conducting device. This results in the ability to use a low power lamp, yet results in the same level of illumination for the camera's field of view. Since the inspection instrument operates at a low voltage and draws a lower amount of current for the light source, battery power may be used in one embodiment. A camera having a memory for the digital storage of images and programable operation may be run on battery power due to the increased efficiency of the light source disclosed. This embodiment is particular useful in situations where a small borehole is involved in which large support cables containing power and data cables will not fit and/or where only slickline is available.

It will be apparent from the foregoing that while particular forms of the invention have been illustrated and described, various modification can be made without departing from the spirit and scope of the invention. Accordingly, it is not intended that the invention be limited except by the appended claims.

What is claimed is:

1. An inspection instrument for insertion into a borehole for viewing the condition and contents of the borehole, the inspection instrument connected to a surface station by means of a cable, the inspection instrument comprising:

a housing having a longitudinal axis, a proximal end, and a distal end, the proximal end connected to the cable;

a camera enclosed within the housing and having a field of view outside the housing;

a light source enclosed within the housing and separated longitudinally from the camera;

an elliptical reflector disposed about the light source to reflect light generated by the light source to a focal point;

a light conductor having a proximal end disposed at the focal point for receiving light reflected by the reflector, the light conductor having a distal end disposed at the camera and oriented to radiate light into the field of view of the camera.

2. The inspection instrument of claim 1 wherein the light source is located at a first focal point of the reflector and the proximal end of the light conductor is located at a second focal point of the reflector.

3. The inspection instrument of claim 2 wherein the light conductor branches out to form an array of light sources disposed to radiate light into the camera's field of view.

4. The inspection instrument of claim 2 wherein the reflector and the proximal end of the light conductor are movable in relation to each other so that they can be precisely positioned in relation to each other.

5. The inspection instrument of claim 1 wherein the light conductor comprises an optical fiber.

6. The inspection instrument of claim 5 wherein the light conductor comprises a plurality of optical fibers having distal ends and proximal ends wherein the proximal ends are formed into a bundle and are disposed at the focal point and the distal ends are formed into an array disposed about the camera so that they radiate light into the field of view of the camera.

7. The inspection instrument of claim 6 wherein the light source is located at a first focal point of the elliptical reflector and the proximal ends of the optical fibers are located at a second focal point of the elliptical reflector.

8. The inspection instrument of claim 6 wherein the distal ends of the optical fibers are evenly spaced about the perimeter of the camera to form the array.

9. The inspection instrument of claim 1 further comprising a lens positioned in front of the distal end of the light conductor and shaped so as to direct light radiated from the distal end of the conductor into the field of view of the camera.

10. The inspection instrument of claim 9, wherein the lens comprises an annular ring with an outward facing surface of concave curvature.

11. The inspection instrument of claim 1 further comprising an internal power supply for supplying the entire electrical power used by the light source and the camera, the internal power supply comprising a battery pack.

12. The inspection instrument of claim 11 wherein the battery pack comprises a commercially available battery of a standard size.

13. The inspection instrument of claim 12 wherein the battery is a D-cell battery.

14. The inspection instrument of claim 11 wherein the battery pack comprises a lithium battery.

15. The inspection instrument of claim 1 wherein the camera is disposed at the distal end of the housing with a field of view forward in relation to the housing and the light source is longitudinally separated from the camera located at a position proximal of the camera.

16. The inspection instrument of claim 1 further comprising a digital memory connected to store images created by the camera in digital form.

17. The inspection instrument of claim 16 further comprising a processor connected to the camera and memory, the processor being programmed to capture images from the camera at programmed times and to store the captured images in the memory.

18. The inspection instrument of claim 17 wherein the processor is also connected to the light source and is programmed to energize the light source prior to the time that the processor receives an image from the camera.

19. The inspection instrument of claim 17 further comprising:

an internal power supply for supplying the entire electrical power used by the instrument, the internal power supply comprising a battery pack; and a slickline connected to the instrument to control the depth of the instrument.

20. An inspection instrument for insertion into a borehole for viewing the condition and contents of the borehole, the inspection instrument comprising:

a housing having a longitudinal axis, a proximal end, and a distal end;

a camera enclosed within the housing and having a field of view outside the housing;

a light source enclosed within the housing and separated longitudinally from the camera such that the camera is at least partially insulated from heat generated by the light source;

a reflector disposed about the light source to reflect light generated by the light source, the reflector having a first focal point and a second focal point, the second focal point being removed from the first focal point, wherein the light source is located at the first focal point; and a light conductor having a proximal end disposed approximately at the second focal point for receiving light reflected by the reflector, the light conductor having a distal end disposed at a position in the housing in relation to the camera so as to radiate light into the field of view of the camera.

21. The inspection instrument of claim 20 wherein the light conductor comprises an optical fiber.

22. The inspection instrument of claim 21 wherein the light conductor comprises a plurality of optical fibers having distal ends and proximal ends wherein the proximal ends are formed into a bundle and are disposed at the second focal point and the distal ends are formed into an array disposed about the camera so that they radiate light into the field of view of the camera.

23. The inspection instrument of claim 22 wherein the distal ends of the optical fibers are evenly spaced about the perimeter of the camera to form the array.

24. The inspection instrument of claim 20 further comprising a lens positioned in front of the distal end of the light conductor and shaped so as to direct light radiated from the distal end of the conductor into the field of view of the camera.

25. The inspection instrument of claim 24 wherein the lens comprises an annular ring with an outward facing surface of concave curvature.

26. The inspection instrument of claim 20 further comprising an internal power supply for supplying the entire electrical power used by the light source and the camera, the internal power supply comprising a battery pack.

27. The inspection instrument of claim 26 wherein the battery pack comprises a commercially available battery of a standard size.

28. The inspection instrument of claim 27 wherein the battery is a standard D-cell battery.

29. The inspection instrument of claim 26 wherein the battery pack comprises a lithium battery.

30. The inspection instrument of claim 20 further comprising a processor connected to the camera and a memory located in the instrument, the processor being programmed to capture images from the camera at programmed times and to store the captured images in the memory.

31. The inspection instrument of claim 30 wherein the processor is also connected to the light source and is programmed to energize the light source prior to the time that the processor receives an image from the camera.

32. The inspection instrument of claim 30 further comprising:

an internal power supply for supplying the entire electrical power used by the instrument, the internal power supply comprising a battery pack; and a slickline connected to the instrument to control the depth of the instrument.

33. An inspection instrument for insertion into a borehole for viewing the condition and contents of the borehole, the inspection instrument comprising:

a housing having a longitudinal axis, a proximal end, and a distal end, the distal end having a transparent window;

a camera enclosed within the housing and having a field of view forward of the housing through the transparent window;

a light source enclosed within the housing and separated longitudinally from the camera;

a focusing device disposed in relation to the light source such that light radiated by the light source is focused at a focal point;

a light conductor having a proximal end disposed at the focal point for receiving light reflected by the reflector, the light conductor having a distal end disposed so as to radiate light into the field of view of the camera;

a memory for storing digital data;

a processor connected to the camera and the memory, wherein the processor is programmed to capture images from the camera at programmed times and to store the captured images in the memory;

a power supply contained within the housing, the power supply connected to the light source, the camera, the processor, and the memory to provide the entire power needs of the instrument; and a cable connected between the inspection instrument and a surface station, the cable containing no power or data conductors.

* * * * *